US005649654A

United States Patent [19]

Hayward, Jr.

[11] Patent Number: 5,649,654

[45] Date of Patent: Jul. 22, 1997

[54] SUPPORTABLE FOOD TRAY WITH BIB

[76] Inventor: William C. Hayward, Jr., 2811 Hwy. 1, Labadieville, La. 70372

[21] Appl. No.: 549,939

[22] Filed: Oct. 30, 1995

[51] Int. Cl.[6] ..... A45F 5/00

[52] U.S. Cl. ..... 224/276; 224/259; 108/43

[58] Field of Search ..... 224/259, 270, 224/575; 108/43; 2/49.1–49.5

[56] References Cited

U.S. PATENT DOCUMENTS

| | | | |
|---|---|---|---|
| 1,191,425 | 7/1916 | Huddle | 45/59 |
| 1,232,089 | 7/1917 | Riebe | 108/43 |
| 1,294,577 | 2/1919 | Wallerstedt | 108/43 |
| 2,289,948 | 7/1942 | Wadsack | 108/43 |
| 2,304,705 | 12/1942 | Pate | 224/25 |
| 2,312,608 | 3/1943 | Wadsack | 132/2 |
| 2,510,646 | 6/1950 | Meers | 108/43 |
| 3,061,390 | 10/1962 | Walsh et al. | 311/17 |
| 3,767,095 | 10/1973 | Jones | 224/270 |
| 4,715,293 | 12/1987 | Cobbs | 108/43 |
| 4,946,094 | 8/1990 | Stang | 2/49.2 |
| 5,062,558 | 11/1991 | Stang | 224/270 |
| 5,221,032 | 6/1993 | Bott et al. | 224/270 |
| 5,421,499 | 6/1995 | Bauer | 224/270 |

*Primary Examiner*—Henry J. Recla
*Assistant Examiner*—Timothy L. Maust
*Attorney, Agent, or Firm*—Pravel, Hewitt, Kimball & Krieger

[57] ABSTRACT

A tray member having an upper surface which is partitioned into a plurality of container portions each of the portions containing a particular food item therein, and other container portions for supporting a circular item such as a cup for drink; a bib portion extending at an angle from the rear edge of the tray, upward, the bib portion of sufficient length to extend from the tray upward, to the upper torso of the person; a pair of shoulder attachments secured to the bib portion, the shoulder attachments each including an upper arcuate arm member which would fit onto the shoulders of the wearer, the shoulder portions being adjustable vertically in order to compensate for the size of the wearer; and a rear extender portion likewise movable in a horizontal manner, the extender portion secured to the side of the tray, and adjustable rearwardly in order to rest against the torso of the wearer, and maintain the tray portion positioned outward from the user, the adjustable shoulder portions and rearward extender portion providing vertical and horizontal adjustment of the apparatus for properly positioning on the wearer.

17 Claims, 4 Drawing Sheets

SUPPORTABLE FOOD TRAY WITH BIB

BACKGROUND OF THE INVENTION

1. Field of the Invention

The apparatus of the present invention relates to food containers. More particularly, the present invention relates to a food tray which is positionable on the upper torso of a person, and includes a bib portion, so that a handicapped person may be given meals on the tray that is secured on his torso without having to sit at a table.

2. General Background

In the care of the elderly, infirmed, or partial invalids, one problem that is particularly difficult to address is the problem of the person feeding himself or herself from a plate seated at a table. For example, if a person is unable to walk or move easily, it is quite difficult for a person to move from a chair or a position where the person may spend a great deal of time to a chair at a table or the like in order to eat meals. Additionally, for such people who are unable to move at all, or because of the lack of control that they may have in their limbs, they are unable to eat from a plate or the like while seated at a table. There is known in the art a type of a tray which serves as a plate also, because it is divided into component chambers for placing of certain items of food within each chamber. Such a tray, however, is the type that would be placed on the surface of a table so that a person may eat from the tray. This type of tray is often used in hospitals or school cafeterias.

However, there still presents the problem of the persons who are unable to sit at the table, yet requires that their food be placed in a type of a tray or plate which does have a partitioned off portion for the various components of food that they may choose to eat, without the person having to be seated at a table. Likewise, because often times a person, for example, with Parkinson's disease, is unable to have a steady hand as they move the food from their plate or tray to their mouth, food often falls from the eating utensil onto their upper torso or their lap, which is undesirable.

Therefore, there is a need in the art for a tray or plate which is partitioned to receive various components of food and/or drink on the tray, and would include a bib like portion for compensating for any food that may fall from a utensil down on the front of the person to be trapped by the bib and fall into the plate or tray. Likewise, it would be beneficial in the art to have this combination of tray and bib secured onto the front of the person so that the person does not have to move from what would normally be their seating to a table in order to eat. In a search done of the art, various patents were obtained as a result of the search, these patents are included in the prior art statement that is submitted with this application.

SUMMARY OF THE PRESENT INVENTION

The apparatus of the present invention solves the problems in the art in a simple and straight forward manner. What is provided is a tray member having an upper surface which is partitioned into a plurality of recessed container portions each of the portions containing a particular food item therein, and other recessed container portions for supporting a circular item such as a cup for drink; a bib portion extending upward at an angle from the rear edge of the tray, the bib portion of sufficient length to extend from the tray to the upper torso of the person; a pair of shoulder attachments secured to the bib portion, the shoulder attachments each including an upper arcuate arm member which would fit onto the shoulders of the wearer, the shoulder portions being adjustable vertically in order to compensate for the size of the wearer; and a rear extender portion likewise movable in a horizontal manner, the extender portion secured to the sides of the tray, and adjustable rearwardly in order to rest against the torso of the wearer, and maintain the tray portion positioned outward from the user, the adjustable shoulder portions and rearward extender portion providing vertical and horizontal adjustment of the apparatus for properly positioning on the wearer. There is further provided a liner, which includes a continuous plastic liner positionable on the tray, the liner conforming to the various chambers in the tray, and having an upper portion conforming to the shape of the bib. The liner would be secured to the tray and bib via a continuous channel which conforms to the raised perimeter border extending along the outer edge of the tray and bib portion so that when the channel is secured upon the raised border, the liner is secured onto the tray and the bib.

Therefore, it is the principal object of the present invention to provide a food tray apparatus which is positionable on a wearer for allowing the wearer to be administered a meal without the person having to be seated at a table;

It is a further principal object of the present invention to provide a tray portion which is positionable on a wearer, the tray portion partitioned into a plurality of recessed container portions for food, and having a bib portion for preventing food from falling into the wearer's lap during a meal;

It is a further object of the present invention to provide an adjustable tray apparatus which is supportable on the shoulders of the wearer and has vertical and horizontal adjustment for proper placement on the wearer during use;

It is a further object of the present invention to provide a food tray which includes a bib portion, the tray and bib portion placed on the torso of a wearer, and having vertical and horizontal adjustment for positioning during a meal.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
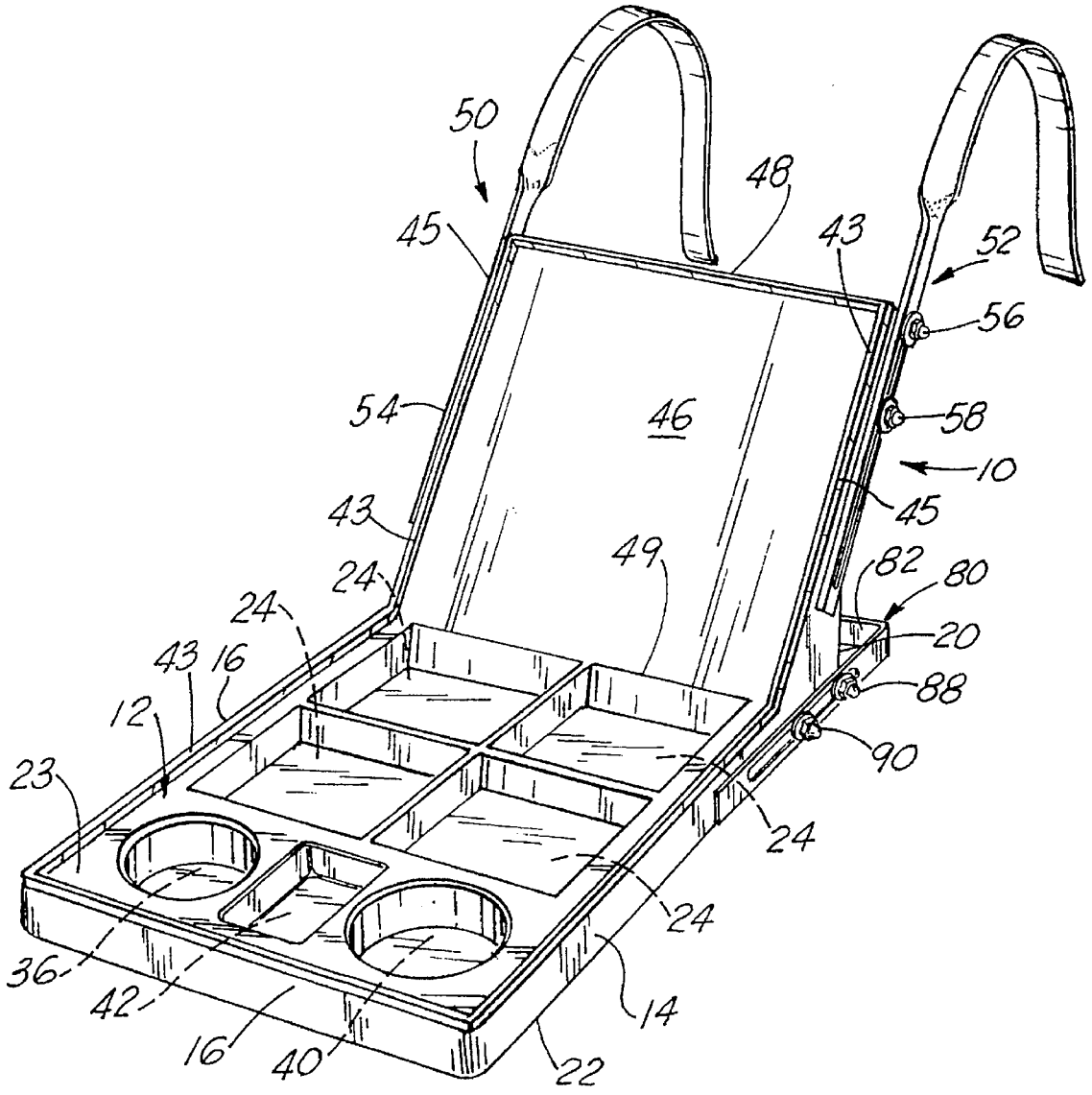
FIG. 1 is an overall perspective view of the preferred embodiment of the apparatus of the present invention.

FIGS. 1–6 illustrate the preferred embodiment of the apparatus of the present invention by the numeral 10. As illustrated in overall view in FIG. 1, apparatus 10 defines a tray portion 12, generally rectangular in shape and having a pair of sidewalls 14, 16, a forward wall 18, and a rear wall 20, each of the walls 14, 16, 18, 20 defining the rectangular tray 12 as illustrated in FIG. 1. The lower surface 22 (not illustrated) of tray 12 would be substantially flat, while the upper surface 23 would include a plurality of recessed rectangular openings 24, as illustrated. In the preferred embodiment, the openings 24 would be separated by divider walls 34 and 36, and defining four open-ended containers for placement of four different food items therein. Further, as illustrated, there is included a pair of recessed circular openings 38, 40, for allowing the placement of a circular container such as a cup or glass to be supported therein. As further illustrated, the tray would include a recessed forward opening 42, where there could be placed either sauce or butter container for use. As illustrated, tray 12 would have a certain depth along its four walls, to accommodate these various recessed openings so that a certain quantity of food could be placed within the openings 24 and the cups could be properly supported within the circular openings 38, 40. Further, as illustrated in the FIGURES, the tray would include a continuous perimeter border 43 extending along the outer edge of the tray, the function of which will be described further.

Figure 5:
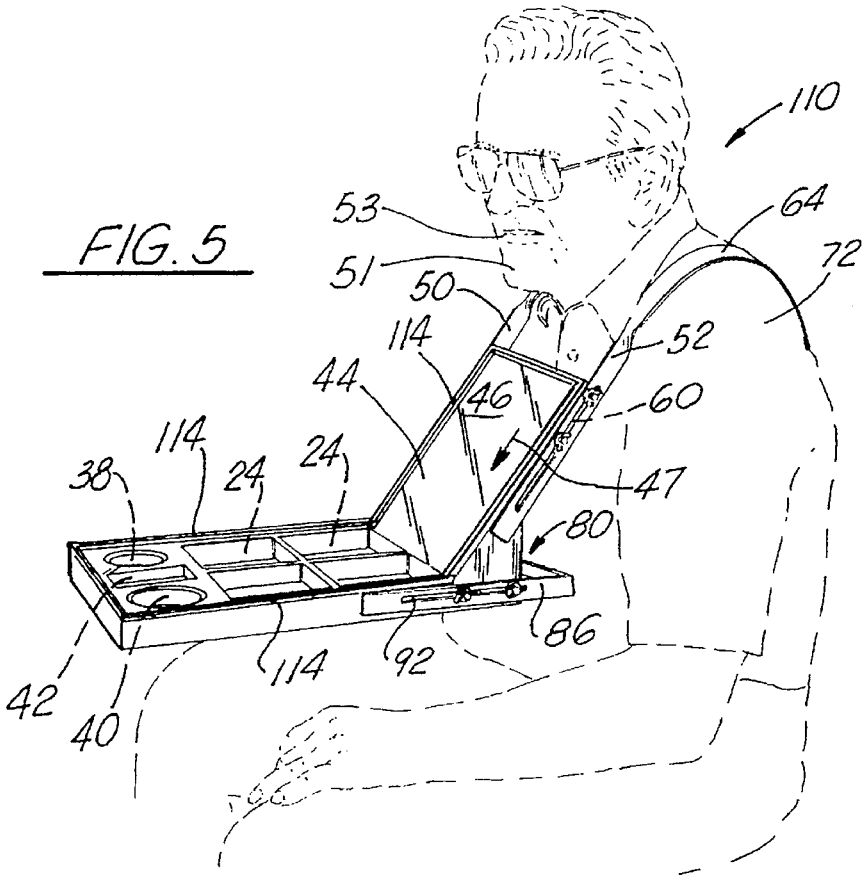
FIG. 5 is an overall view of the preferred embodiment of the apparatus of the present invention positioned on a person during use.

Turning now to the other components of the apparatus there is illustrated a rearward bib portion 44, which would include an upper flat surface 46, extending upward from the tray 12 at an angle of approximately thirty degrees from the vertical, and being of substantially the same width as the tray portion 12. In the preferred embodiment, as illustrated, the bib portion 44 would be an integral component from the tray portion 12 and would be constructed of the same material in a matter that may lend itself to being molded as one component with the tray 12. The bib portion 44 would extend upward at the approximate 30° angle to a height along its upper edge 48, so that the upper edge 48 would be secured near the level of the chin 51 of the wearer, as illustrated in FIG. 5, and the lower edge 49 would be integrated with the rear wall 20 of tray 12. As with tray 12, bib portion 48 would likewise have a continuous raised border 43 around its perimeter edge, and would be substantially integral and mate with the continuous edge 43 of tray 12, so as to define a continuous raised border around both tray 12 and bib 44 as illustrated in the FIGURES. As seen in FIG. 5, the important feature is that the bib portion 44 must be of sufficient height so that should food fall from an eating utensil between the tray 12 and the mouth 53 of the user, the food on its vertical drop would make contact with the upper surface 46 of the bib portion 44, and would then slide along the angulated bib portion 44 (arrow 47), into one of the containers 24 in the tray portion 12.

Figure 4:
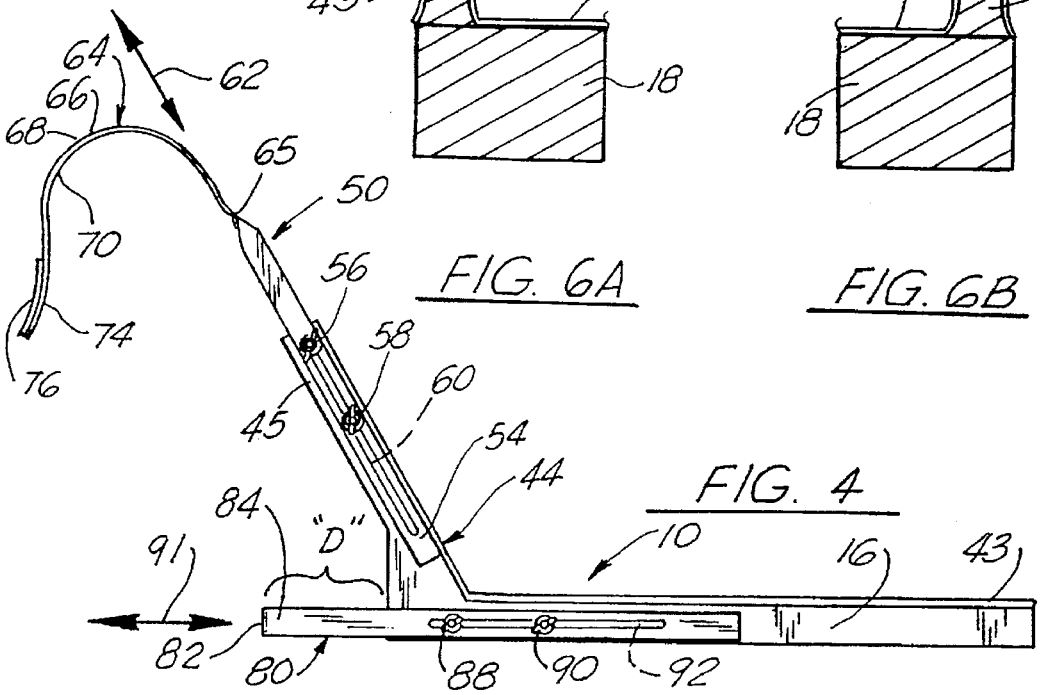
FIG. 4 is a side view of the preferred embodiment of the apparatus of the present invention.

In order to support the tray portion 12 and bib portion 44 on the wearer, reference is made to the shoulder support members 50, 52, as illustrated in the FIGURES. Shoulder members 50, 52 would include a pair of flexible metal or light weight members, having a pair of support end portions 54, which would be secured via bolts 56, 58, to each side wall 45 of the bib portion 44 as illustrated in FIGS. 1 and 4. As is clearly seen, particularly in FIG. 4, the bolt members 56, 58 would be secured into a continuous slot 60, running along the entire portion 54 of the shoulder supports 50, 52, so that the shoulder supports 50, 52 could be adjusted vertically in the direction of arrow 62 as seen in FIG. 4. This is important in view of the fact that since users, who would be of various sizes, may need the bib 44 and tray portion 12 supported at various heights along their torso, and therefore the slot 60 would allow the vertical adjustment of the shoulder supports 50, 52, for proper positioning on the wearer. Further, the shoulder supports would include a pair of arcuate portions 64, extending from the upper edge 65 of the supports 50, 52 and defining a pair of flat curved portions 66, having an upper flat surface 68, and a lower flat surface 70, the lower flat surfaces 70, resting upon the shoulders 72 of the wearer, as illustrated in FIG. 6, and securing the apparatus 10 in place.

For purposes of weight distribution, the far ends 74 of each of the shoulder support members 50, 52, would include a counter weight 76, which may be a length of heavy metal or the like, secured to the ends 74 of the shoulder portions 50, 52, for helping to balance the weight of the tray 12 and bib 44 that would be supported from the front of the wearer.

Turning now to an additional feature of the apparatus 10, reference is made to FIGS. 1 and 4, which illustrate a means for positioning the tray at a certain point distanced from the wearer. This means is a rear support member 80, which includes a transverse bar portion 82 running substantially along the width of the apparatus, and a pair of arm members 84, 86, which extend forward, and are secured to the side walls 14, 16 of the tray portion 12 via bolt members 88, 90. Like the shoulder supports 50, 52, the rear support member 80 includes a continuous slot 92, wherein the bolts 88, 90 are secured, thus enabling the rear support member 80 to be adjustable horizontally, in direction of arrow 91, so that as seen in FIG. 4, the tray 12 may be secured a certain distance "D" from the torso of the wearer, during use. This is important since some of the users may wish to have the tray moved outward or inward, depending on their preferences.

Figure 2:
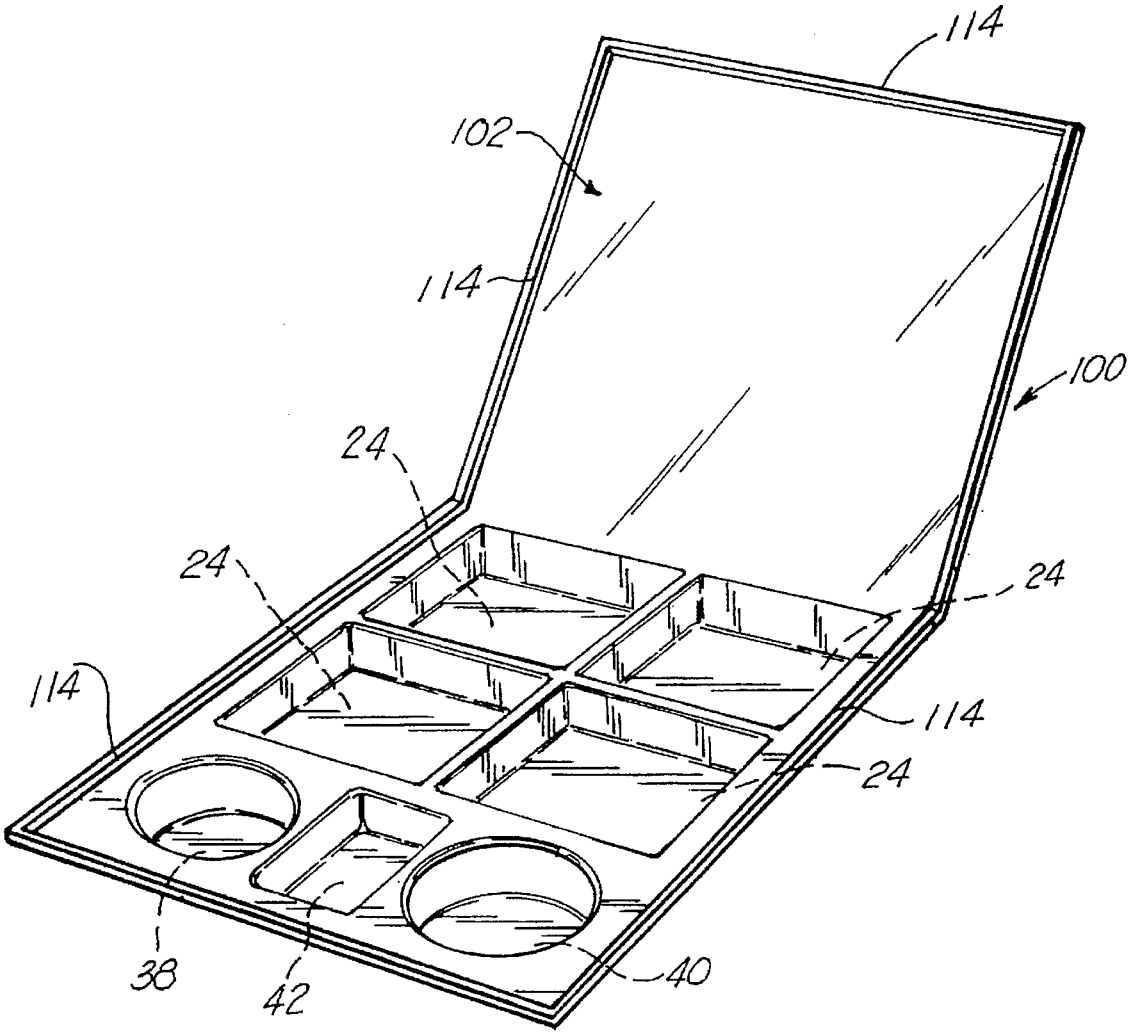
FIG. 2 is an overall view of the plastic liner utilized in the apparatus of the present invention.
Figure 3:
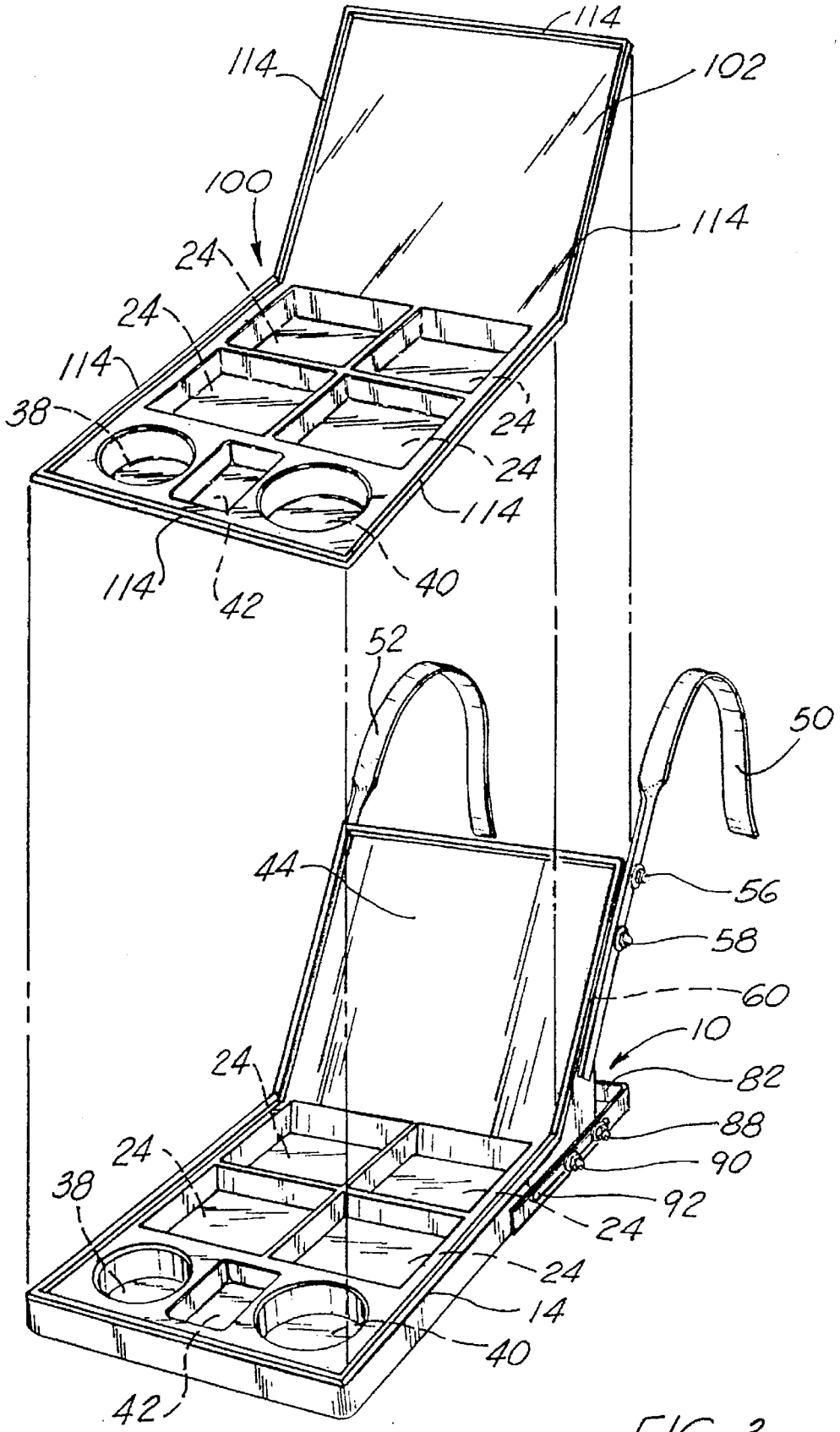
FIG. 3 is an overall perspective view of the apparatus of the present invention, illustrating the liner being positioned thereon.

An additional feature of the present invention includes a liner means 100, which is illustrated in FIG. 2–3. Liner means 100 would be substantially of thin plastic which would have been molded to be placed upon the tray portion 12 and having the identical recessed containers 24, 38, 40, 42 formed therein for being slidingly engaged into the tray portion 12 in a manner as illustrated in FIGS. 2 and 3. Further, liner means 100 would include an integral bib portion 102, which would be placed upon the forward face 46 of the bib 44. In order to secure liner means 100 in place on tray 12 and bib 44, there would be provided a channel 114 formed along the outer perimeter edge of liner means 100, and configured so as channel 114 secures tightly along the entire length of raised border 43 of tray 12 and bib portion 44, so that when channel 114 is secured along raised border 43, the entire liner means is firmly secured along the outer edge of the liner 100 onto the tray 12 and bib portion 44 so as to maintain it in position.

Figure 6A:
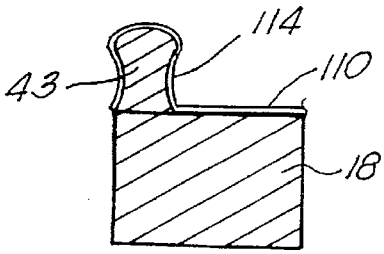
FIGS. 6A and 6B are cross-sectional partial views of the tray with the liner secured thereupon.
Figure 6B:
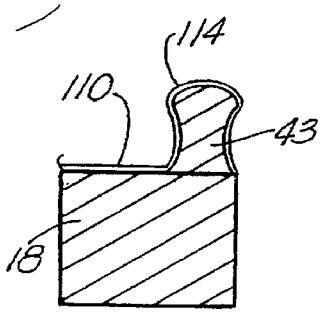

This securing of channel 114 along raised border 43 is seen more clearly in FIGS. 6A and 6B, which illustrate in partial cross-sectional view the manner in which the channel 114 is secured upon raised border 43, in order to secure the liner in place completely around its perimeter.

Therefore, once the liner 100 is in place as illustrated in FIG. 3, the food and drink could be placed within the liner 100 and after finishing the meal, rather than having to clean the tray portion 12, the liner 100 would simply be removed from the tray portion 12 and dispensed with, thus allowing the tray 12 and bib portion 44 to be used further without the additional step of having to clean it. As was stated earlier, preferably the liner would be a light weight molded plastic which would easily fit into the tray portion 12 and could be disposed of after use.

The entire apparatus is seen clearly in use in FIG. 5, where there is illustrated a person 110, wearing the apparatus for use. As illustrated, the shoulder members 50, 52 are positioned over the shoulder of the wearer 110, and the bib portion 44 is extending upward from the rear portion of the tray 12, to a point that should food fall from mouth 53 of the wearer 110, it would contact the bib portion 44 as seen by arrow 55. Further, the tray 12 is secured extending outward from the wearer 110, the tray 12 positioned in such a manner that the rear support member 80, has extended it outward from the wearer 110 to a position that the wearer 110 feels comfortable by adjusting along slot 92. Likewise, the shoulder supports 50, 52 have been properly adjusted along the continuous slot 60, so that the tray 12 is of the proper height for the wearer to feel comfortable in its use.

One additional function of the raised border 43 on tray 12 and bib 44, is in addition to securing the liner 100 in place, it would serve as a means for preventing food from sliding off of the upper surface of tray 12, if food were to be dropped onto that portion or would be pushed by the user out of the various containers 24. Instead of the food sliding off of the tray, the food would engage the upper raised portion 43, and would be maintained upon the tray 12 as indicated.

For purposes of use as was stated earlier, this apparatus could be used for the elderly and infirmed and particularly people who would have a difficult time maintaining food on their eating utensils such as sufferers of Parkinson's disease. Likewise, for people who are partially or totally blind, because of the nature of the containers positioned on the tray portion, a blind person would know exactly which container housed a particular food, and in doing so, could eat from the tray portion quite easily. Likewise, because of the bib portion, if the blind person would spill during eating, the food would make contact with the bib portion and would slide back into the containers of the tray portion. The tray would of course, be constructed of material that is as light weight as possible yet would be able to hold a quantity of foods as illustrated and could be easily cleaned by disposing of the plastic liner, or if the liner is not utilized, by simply cleaning the tray portion itself.

The following table lists the part numbers and part descriptions as used herein and in the drawings attached hereto.

PARTS LIST

| Description | Part No. |
|---|---|
| apparatus | 10 |
| tray portion | 12 |
| raised lip member | 13 |
| side walls | 14, 16 |
| forward wall | 18 |
| rear wall | 20 |
| lower surface | 22 |
| upper surface | 23 |
| openings | 24 |
| divider walls | 34, 36 |
| circular openings | 38, 40 |
| forward opening | 42 |
| raised border | 43 |
| bib portion | 44 |
| side wall | 45 |
| flat surface | 46 |
| arrow | 47 |
| upper edge | 48 |
| shoulder support members | 50, 52 |
| chin | 51 |
| mouth | 53 |
| support end portions | 54 |
| bolts | 56, 58 |
| continuous slot | 60 |
| arrow | 62 |
| arcuate portions | 64 |
| upper edge | 65 |

-continued

PARTS LIST

| Description | Part No. |
|---|---|
| flat curved portion | 66 |
| upper flat surface | 68 |
| lower flat surface | 70 |
| shoulders | 72 |
| far ends | 74 |
| counter weight | 76 |
| rear support member | 80 |
| transverse bar portion | 82 |
| arm members | 84, 86 |
| bolt members | 88, 90 |
| arrow | 91 |
| continuous slot | 92 |
| liner means | 100 |
| bib portion | 102 |
| upper edge | 106 |
| person | 110 |
| continuous channel | 114 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A food tray apparatus, comprising;

a) a food tray portion divided into a plurality of compartments for accommodating various items of food and drink;

b) a bib portion extending upward from a rear of the food tray portion to a point below a person's mouth, so that food dropping from an eating utensil as food is moved from the food tray portion to the person's mouth falls on the bib portion;

c) support members extending upward from edges of the bib portion, the support members defining a means for engaging over a person's shoulders, for positioning the food tray portion to extend outward from the person at substantially mid-torso;

d) a rear support bracket extending from the rear of the food tray portion and contacting the person's torso, so that the food tray portion, while supported by the support members on the shoulders of the person is held spaced apart from the person's torso; and e) a plastic liner conforming to the shape of the food tray portion and bib portion for receiving food to be eaten, said plastic liner being removable and disposable after use.

2. The food tray apparatus in claim 1, wherein the compartments positoned on the food tray apparatus are divided into four compartments for placing of a separate food item in each compartment.

3. The food tray apparatus in claim 1, wherein the shoulder support members are extendable and retractable in a vertical plane for allowing the tray to be raised or lowered on the torso of the person.

4. The food tray apparatus in claim 1, wherein the rear support bracket engaged to the tray portion is extendable and retractable in relation to the tray for supporting the tray at different distances from the torso of the person.

5. The food tray apparatus in claim 1, wherein the bib portion is integral with the tray portion, so that the apparatus may be moved or stored as a single apparatus.

6. The food tray apparatus in claim 1, further comprising counterweights positioned at a rear end of the support members to balance the weight of the food tray supported on a front of the person's torso.

7. The food tray apparatus in claim 1, wherein the food tray portion and the bib portion further comprise a continuous raised border around the perimeter of each of the food tray portion and bib portion.

8. The food tray apparatus in claim 2, wherein the plastic liner further comprises a continuous channel formed in the outer edge of the bib portion which engages onto a raised border of the food tray portion for being secured thereto.

9. A food tray apparatus, comprising:

a) a food tray portion divided into a plurality of open-ended compartments for accommodating various items of food and drink;

b) a bib portion extending rearwardly upward from the rear of the food tray portion to a point below the mouth of the person, so that food dropping from an eating utensil as food is moved from the food tray portion to the person's mouth falls on the bib portion;

c) a pair of support members extending upward from the side edges of the bib portion, the pair of support members engaging over the shoulders of a person, for supporting the food tray portion to extend outward from the person at substantially mid-torso;

d) a rear support bracket extending from the rear of the food tray portion and contacting the torso of the person, so that the food tray portion, while supported by the support members on the shoulders of the person is held spaced apart from the person's torso; and e) a one-piece molded plastic liner conforming to the shape of the food tray portion and bib portion, and positionable upon the food tray portion and bib portion, for receiving food to be eaten, said plastic liner further comprising a continuous channel along its outer edge for engaging onto a raised border along the outer edge of the food tray portion and the bib portion.

10. The food tray apparatus in claim 9, wherein the plurality of open-ended compartments further comprise four compartments for placing of a separate food item in each compartment.

11. The food tray apparatus in claim 9, further comprising an elongated channel formed in a wall of the bib portion for allowing the support members to extend and retract in a vertical plane so that the tray may be raised and lowered to various positions on the torso of the person.

12. The food tray apparatus in claim 9, wherein the rear support bracket is engaged to the tray portion by bolts engaged within an extended channel, allowing the rear support bracket to extend and retract in relation to the tray for supporting the tray at different distances from the torso of the person.

13. The food tray apparatus in claim 9, wherein the bib portion is integral with the tray portion, so that when food falls onto the bib portion, the food falls into the tray portion.

14. The food tray apparatus in claim 9, further comprising counterweights positioned at a rear end of the support members to balance the weight of the food tray portion supported on the front of the wearer.

15. A food tray apparatus, comprising:

a) a food tray portion divided into a plurality of open-ended compartments for accommodating various items of food and drink;

b) a bib portion extending rearwardly upward from a rear of the food tray portion to a point below a person's mouth, so that food dropping from an eating utensil as food is moved from the food tray portion to the person's mouth falls on the bib portion;

c) the food tray portion and bib portion further including a continuous raised border along outer edges respectively;

d) a pair of adjustable support members extending upward from side edges of the bib portion, the pair of support members engaging over a person's shoulders, for supporting the food tray portion to extend outward from the person at substantially mid-torso;

e) an adjustable rear support bracket extending from the rear of the food tray portion and contacting the torso of the person, so that the food tray portion, while supported by the support members on the shoulders of the person is held spaced apart from the person's torso;

f) a one-piece molded plastic liner conforming to the shape of the food tray portion and bib portion, and engaged upon the food tray portion and bib portion via a continuous channel formed in its outer edge for engaging a raised border of the food tray portion and bib portion, for receiving food to be eaten, said plastic liner being removable and disposable after use; and g) counterweights positioned at a rear end of the support members to balance the weight of the food tray portion supported on the person's torso.

16. The food tray apparatus in claim 15, further comprising an elongated channel formed in a wall of the bib portion for allowing the support members to extend and retract in a vertical plane so that the tray may be raised and lowered to various positions on the torso of the person.

17. The food tray apparatus in claim 15, wherein the adjustable rear support bracket is engaged to the tray portion by bolts engaged within an extended channel, allowing the rear support bracket to extend and retract in relation to the tray for supporting the tray at different distances from the torso of the person.

* * * * *